US005203714A

United States Patent [19]

Tuan

[11] Patent Number: 5,203,714

[45] Date of Patent: Apr. 20, 1993

[54] ELECTRICAL CONNECTOR FOR A PRINTED CIRCUIT BOARD

[76] Inventor: Kenny Tuan, 5F, No. 30, Lane 423, Yuan Shan Rd., Chung Heh City, Taipei County, Taiwan

[21] Appl. No.: 900,147

[22] Filed: Jun. 18, 1992

[51] Int. Cl.[5] ..... H01R 13/62

[52] U.S. Cl. ..... 439/326; 439/329

[58] Field of Search ..... 439/326-329, 439/152-160, 630-637

[56] References Cited

U.S. PATENT DOCUMENTS

| | | | |
|---|---|---|---|
| 4,986,765 | 1/1991 | Korunsky et al. | 439/326 |
| 5,094,624 | 3/1992 | Bakke et al. | 439/326 |
| 5,112,242 | 5/1992 | Choy et al. | 439/326 |
| 5,123,857 | 6/1992 | Chao | 439/326 |

*Primary Examiner*—David L. Pirlot

[57] ABSTRACT

An electrical connector for printed circuit boards comprises an insulative housing having opposing end portions with an insertion face defined therebetween, and a pair of metal latching assistor members. Each end portion has a resilient latching plate extending upwardly therefrom and a similarly directed positioning post and anchor bar to either side of the plate. A protruding pin and abutment are provided respectively on the positioning post and latching plate, on a side thereof opposite from the post, for the positioning of a printed circuit board held therebetween. The U-shaped latching assistor members are disposed between the anchor bars and latching plates of respective end portions of the housing, wherein each assistor member has a first leg thereof retained within an axial groove formed in an associated anchor bar. A second leg of each assistor member, which is resiliently adjoined with the first through a central bight, has a pair of hook shaped grapnel elements that are engaged over the upper end of an associated latching plate and an inclinate tab disposed therebetween for effecting the flexure of the assistor member and plate.

12 Claims, 5 Drawing Sheets

ELECTRICAL CONNECTOR FOR A PRINTED CIRCUIT BOARD

BACKGROUND OF THE PRESENT INVENTION

The present invention relates to an electrical connector for a printed circuit board, and more particularly to an electrical connector having an insulative housing on which is provided resilient latching members integral therewith for the releasable securement of a printed circuit board, wherein the latching members are actuated via assistor members.

Socket type connectors for printed circuit boards have steadily evolved from the common direct insertion types to various alternate forms of connectors that attempt to overcome the deficiencies of the former. One important type of connector belonging to the latter category includes those connectors characterized in that a printed circuit board is installed by first intromitting the board therein at a first angle with respect to the housing of the connector and then rotating the board into a functional position on the housing, wherein the board is in electrical communication with the conductive terminals within the housing and is held in position by means of resilient latches in abutment with side portions thereof.

These types of connectors can be further categorized in accordance with the implementation of their latching means. In a first method, the connectors are provided with integral resilient latching members on the insulative housings thereof that are flexed into and out of engagement with a printed circuit board. Exemplary connectors of this type were disclosed by Walse et al in U.S. Pat. No. 4,575,172 (Mar. 11, 1986) and by Regnier et al in U.S. Pat. No. 4,713,013 (Dec. 15, 1987). Though being quite effective, the integrally molded latching members employed therein tend to fail after repeated flexures. Even in the connectors of this type having more robust structures, creep deformation after extended usage especially at elevated temperatures tends to be inevitable. A second later method of implementation was devised in order to overcome these and other shortcomings of integral latch type connectors, wherein a separately attached latching member of pressed metal provides securement between the connector and printed circuit board. Various specific implementations have been brought forth in the prior art including those disclosed by Korsunsky et al in U.S. Pat. Nos. 4,995,825 (Feb. 26, 1991) and 5,013,257 (May 7, 1991), and by Yagi et al in U.S. Pat. No. 5,004,429 (Apr. 2, 1991).

The connector of the instant disclosure employs both integral latch members and separately formed and attached metal assistor members, whereby the resilient assistor members assume the major portion of the applied forces during insertion or removal of a printed circuit board so as to overcome the frangibility problems of the integral latch connectors. The connector of the present invention provides for a synthetic housing and formed metal members of relatively simpler geometry in comparison with the corresponding members on connectors relying entirely on separate latching members for resilient securement. Tooling expenses and material expenditures in manufacturing would thus be correspondingly less. In addition, the dimensional tolerances of the separately formed latching members and housing of the prior art connector result in inherent inaccuracies in the positioning of the abutment surfaces on the former once it is disposed within the receiving recesses or cavities of the housing. The tolerances of a circuit board positioned thereby further exacerbates this problem which can adversely influence the smooth operation of the latching members or even accelerate wear in the connector. Further, as the metal latching members of the prior art connectors would contact directly a printed circuit board held thereby, possible shorting or reactive coupling of the densely packed circuitry thereon could occur. Whereas, in the connector of the present invention the actual latching surfaces used are unitarily formed with the insulative housing thereof. Yet another advantage of the connector of the present invention stems from the horizontal alignment of the actuating tabs thereon, i.e. the manipulating portions of the assistor members that enable their flexure. Typically, the metal latching members of the prior art connectors, as in the aforementioned disclosure of Korsunsky et al and Yagi et al, have corresponding members that are vertically aligned such as to dictate manipulation from a lateral side of their housings that requires force application along a substantially horizontal direction. This arrangement can prove problematical in a dense environment where space is limited, making access to the latching members difficult. The horizontally aligned actuating tabs employed in the connector of the present invention, however, can be manipulated from a vertical orientation directly over the housing without requiring access to the surrounding lateral spaces. The usability and convenience of the electrical connector is thus also significantly increased.

SUMMARY OF THE PRESENT INVENTION

The electrical connector for a printed circuit board of the present invention comprises an insulative housing having opposing end portions and an insertion face disposed therebetween and a pair of metallic latching assistor members. Each end portion has a resilient latching plate extending upwardly therefrom and a similarly directed positioning post and anchor bar to either side of the plate. A protruding pin and abutment are provided respectively on the positioning post and latching plate, on a side thereof opposite from the post, for the positioning of a printed circuit board held therebetween. The latching assistor members are disposed between the anchor bars and latching plates of respective end portions of the housing, wherein each assistor member has a first portion thereof retained within an axial groove formed in an associated anchor bar. A second portion of each assistor member, which is resiliently adjoined with the first, has a pair of hook shaped grapnel elements that are engaged over the upper end of an associated latching plate and an inclinate tab disposed therebetween. Each assistor member can be flexed so as to bend the latching plates carried thereby towards their associated anchor bars by applying force against the inclinate tabs thereon. In so doing, a printed circuit board can be intromitted at an acute angle into a receiving recess in the insertion face, and rotated thereabout to bring a first side thereof into abutment with the positioning posts with the pins thereon engaging corresponding securing apertures on the board. The assistor elements recover to their original orientation upon release of the tabs thereon, as do the latching plates, so as to engage the protruding abutments thereon with corresponding portions of a second side of the printed circuit board adjacent opposing edges thereof, with the board now being secured in a functional position on the housing.

The present invention has as a main object of providing an electrical connector for printed circuit boards of improved characteristic having greater reliability and ease of use. A further object of the present invention is to provide an electrical connector for printed circuit boards of simplified manufacture and which provides increased material efficiency.

A more thorough understanding of the present invention will be obtained by referring to a detailed description of the preferred exemplary embodiments thereof, provided below along with accompanying drawings.

FIG. *7a* is a perspective view showing the first latching assistor member having an alternate retaining means provided thereon.

FIG. *7b* is a sectional view of the latching assistor member of FIG. *7a* engaged through a slot formed in the end portion of the housing.

FIG. *7c* is a perspective view showing the second latching assistor member having the alternate retaining means provided thereon.

DETAILED DESCRIPTION OF THE PREFERRED EMBODIMENTS

Figure 1:
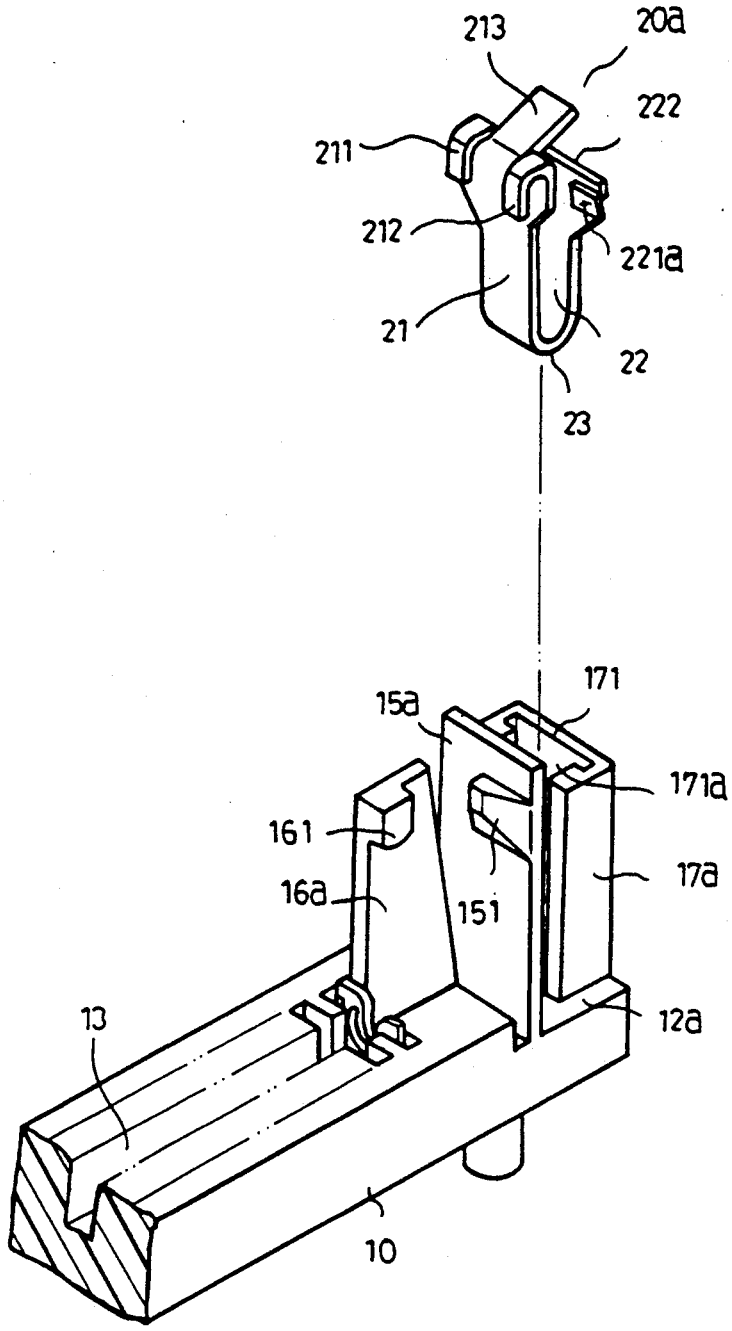
FIG. 1 is a perspective view showing a latching assistor member and one end of a housing of a printed circuit board connector of the present invention.
Figure 3:
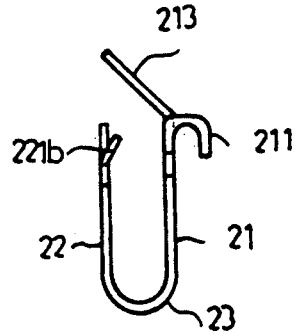
FIG. 3 is a side view of the latching assistor member.
Figure 2:
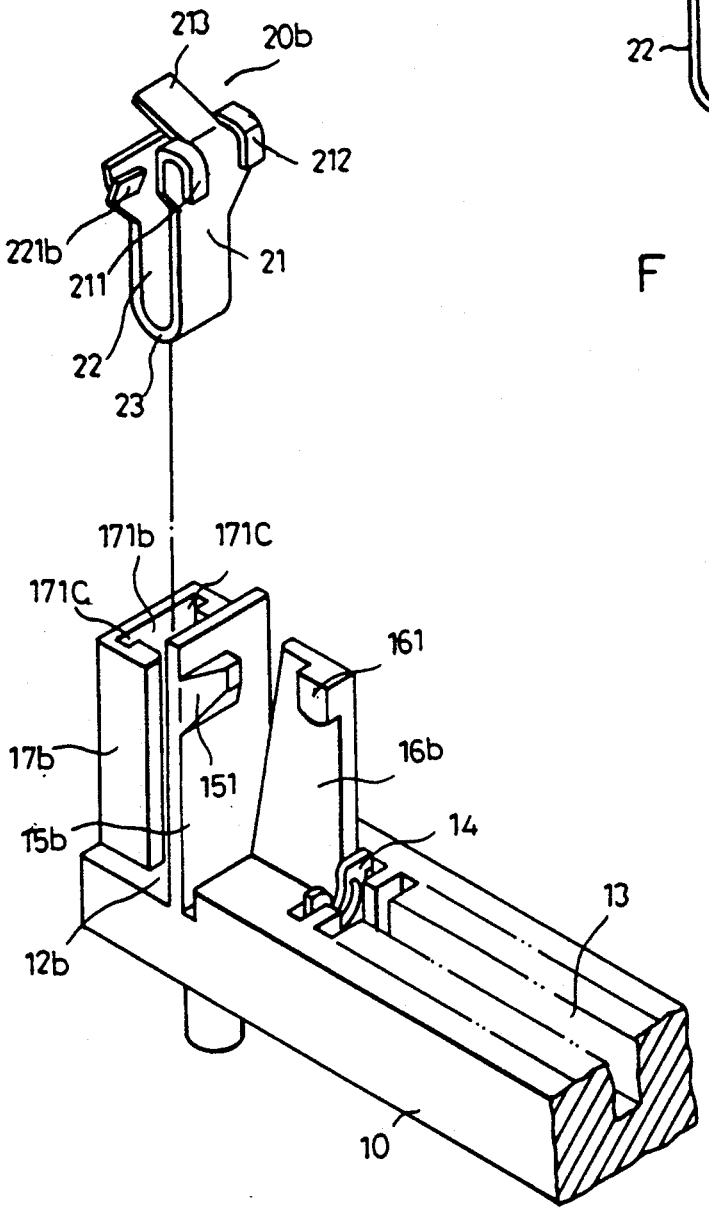
FIG. 2 is a perspective view showing a second latching assistor member and another end of a housing of the printed circuit board connector.

Referring to FIGS. 1 and 2 of the drawings, an electrical connector for printed circuit boards in accordance with the present invention comprises an elongate, insulative housing 10 and a pair of latching assistor members 20 of pressed metal.

Housing 10 has an elongate insertion face 11 defined thereon between recessed end portions 12*a*, 12*b*. A trough like recess 13 formed along the insertion face 12 is provided with a plurality of conductive terminals 14 therein. The conductive terminals engage corresponding connection terminals on an edge portion of a printed circuit board when disposed in a functional position in the recess. An integral, resilient latching plate 15*a*, 15*b* extends perpendicularly upwards from respective end portions 12*a*, 12*b* at a medial position thereon. Each latching plate is provided with a protruding abutment 151 at a predetermined position on a first side thereof adjacent a lateral edge. A positioning post 16*a*, 16*b* extends perpendicularly upwards from the respective end portions, being disposed opposite the first side of respective plates 15*a*, 15*b* proximate a longitudinal edge of the housing. A pin 161 protruding from each post 16*a*, 16*b* is directed substantially parallel with respect to the first side of an associated plate towards the opposing longitudinal edge of the housing. An integral anchor bar 17*a*, 17*b* extends perpendicularly upwards from the respective end portions, being disposed opposite a second side of respective plates 15*a*, 15*b*. Each bar 17*a*, 17*b* is provided with a reentrant groove 171 extending along the longitudinal axis thereof and having an opening 171*a* facing the second side of an associated latching plate.

The latching assistor members 20*a*, 20*b* are generally U-shaped and comprise two legs 21 and 22 adjoined by a central bight 23. Legs 21 have a broadened terminal end portion on which is formed a pair of overhanging, hook shaped grapnel elements 211, 212 adjacent respective lateral sides thereof. An inclinate tab 213 is formed between the grapnel elements on each leg 21 extending upwards therefrom on a side of the leg opposite from the grapnel elements. A broadened terminal end portion of legs 22 have a pair of inclinate outer flaps 221*a*, 221*b* formed thereon adjacent respective lateral sides. The upwardly directed flaps are spaced from the upper edge of the terminal end portion and incline towards the opposing leg 21.

Figure 5:
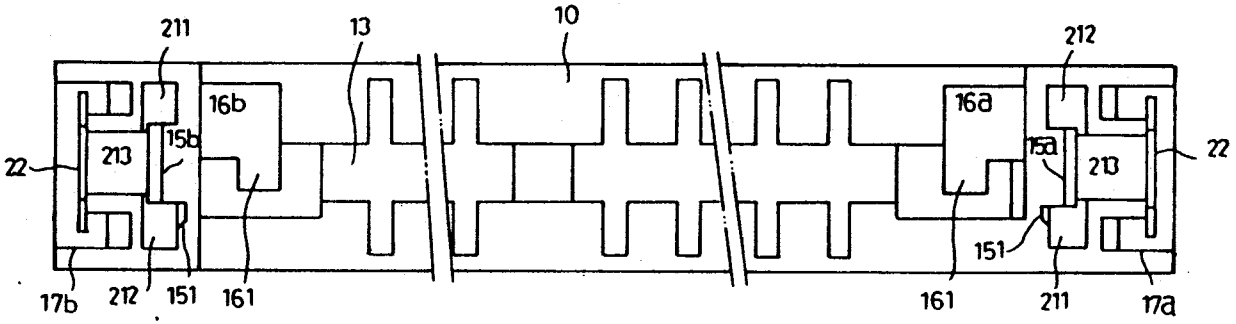
FIG. 5 is a plan view of the housing with the latching assistor members in place.
Figure 4:
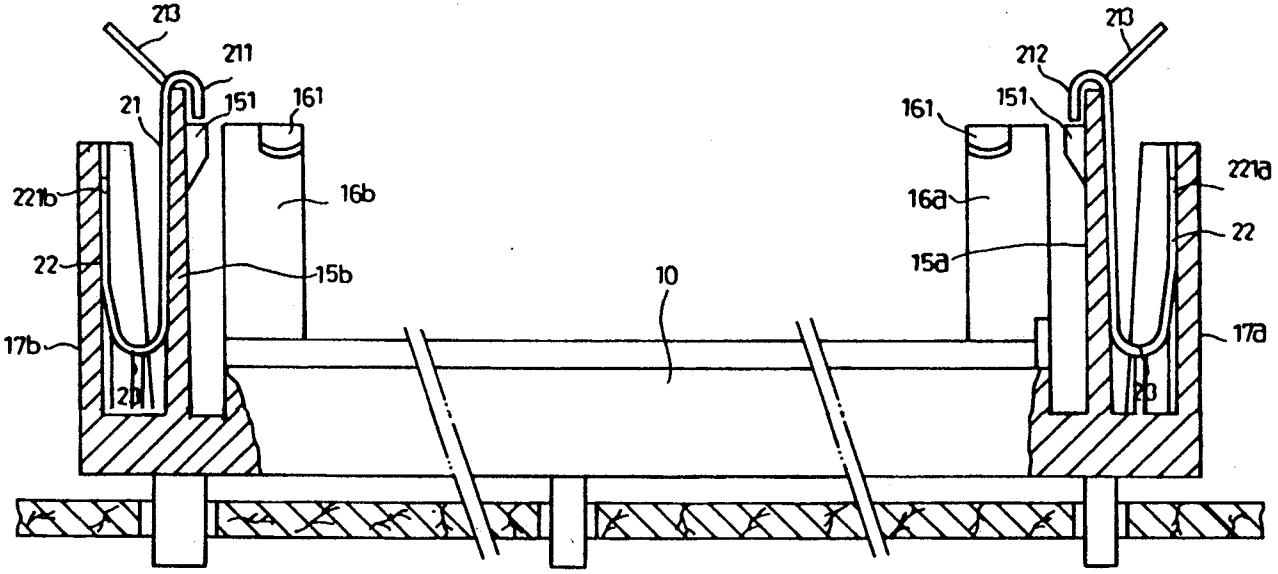
FIG. 4 is sectional view of an end portion of the housing with a latching assistor member disposed therein.

Referring to FIGS. 4 and 5, each latching assistor member 20*a*,20*b* is disposed on a respective end portion between associated bars 15*a*,15*b* and plates 17*a*,17*b* with bights 23 thereof in a lower position so as to be in proximity with the bases of associated latching plates. Tabs 213 thereon are directed away from associated latching plates toward the positions of associated anchor bars on the respective end portions. Leg 22 of the latching assistor members are slidingly engaged within respective grooves 171 of the anchor bars in a tongue and groove like fashion. Wherein, each groove 171 has a broadened rear section 171*b* in communication with the opening 171*a* thereof which defines a pair of opposing lateral grooves 171*c*, and the laterally protruding portions of the broadened ends of legs 22 on which outer flaps 221*a*,221*b* are formed define respective tongues for engagement with the lateral grooves 171*c* in the anchor bars. The outer flaps 221*a*,221*b* on each leg 22 are compressed toward a common plane when the leg is inserted into an associated groove 171. The wedging action of the resilient flaps within the anchor bars acts to retain the latching assistor members on respective end portions 12*a*,12*b* of the housing. The other leg 21 of each latching assistor member is coupled with an associated plate 15*a*,15*b* by means of the grapnel elements 211,212 thereon which are engaged with the upper terminal ends of the latching plates opposite from the bases thereof. The end portions of each grapnel element 211,212 overhang the first side of an associated plate 15*a*,15*b* and are separated therefrom by a predetermined space A.

In operation, a printed circuit board is secured in a functional position on housing 10 by first concurrently applying an appropriate force on the tabs 213 of both the latching assistor members so as to effect their flexure. Wherein, each leg 21 is displaced towards an associated leg 22 secured to an anchor bar. In so doing, the overhanging end portions of the grapnel elements 211,212 contact the first side of associated plates 15*a*,15*b* after traversing the space therebetween and flex the latching plates carried thereby towards associated anchor bars 17*a*,17*b*. The edge connector portion of a printed circuit board, usually provided with contact plates or "fingers", can then be inserted into recess 13 at a first insertion position defining an acute angle with respect to the insertion face 12, and subsequently rotated thereabout so as to bring a first side thereof into abutment with posts 16*a*,16*b* at which position the board is substantially perpendicular with the insertion face. Concomitantly, pins 161 on the positioning posts engage corresponding cooperating apertures on the printed circuit board to complete the securement thereof, with the board being in a functional position on the housing. Upon gradual release of the tabs 213, the latching assistor members and plates 15*a*,15*b* return to their original orientations so as to bring the protruding abutments 151 into engagement with corresponding portions of a second side of the printed circuit board adjacent opposing edges thereon which are in abutment with the first sides of corresponding plates 15*a*,15*b*. The circuit board can just as easily be removed from the connector by again flexing the assistor member so as to disengage the latching plates and rotating the board away from the positioning posts, afterwhich the edge connector portion of the board can be retracted from the housing.

A major portion of the work performed in displacing the latching plates towards their associated anchor bars is expended in deforming the assistor members with relatively little energy being expended in bending the plates themselves. As such the latching plates employed in the present invention would be comparatively thinner in section relative to the corresponding members of board connectors that rely totally on the resilience of their integral latching plates, sans comparable latching assistors. In addition to the materials savings made possible thereby, the present latching plates would also be less prone to fatigue failure and creep deformation. Further to this end, due to the initial space between the grapnel elements 211,212 and associated latching plates 15*a*,15*b* the lower portions of each leg 21 are against a medial portion of the latching plates so as to act as fulcrums through which the latter are flexed. Bending stresses are thereby not imposed upon the base juncture between the latching plates and their associated end portions where fatigue fractures would otherwise likely occur.

Figure 6:
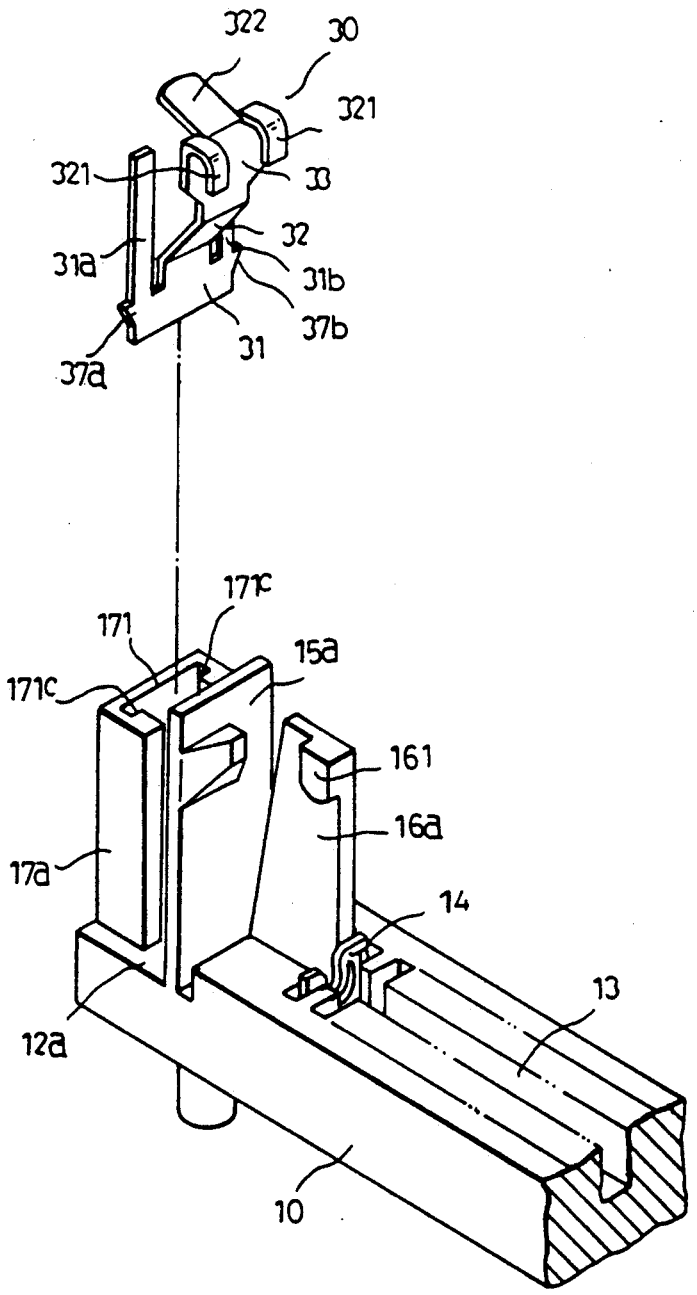
FIG. 6 is a perspective view showing the housing and an alternate embodiment of the latching assistor member.

FIG. 6 shows an alternate embodiment of a latching assistor member wherein the member 30 comprises an insertion plate 31 having an inclinate arm 32 extending from a medial position thereon. A broadened backing plate 33 which serves the same function as leg 21 of the latching assistor member of the previous embodiment is adjoined with the upper end of arm 32. A pair of hook shaped grapnel elements 321 and a central inclinate tab 322 provided thereon are similarly arranged with those on legs 21 of the prior embodiment. A vacancy on the insertion plate opposite from arm 32 defines a pair of lateral slats 31*a*, 31*b* which act as tongues for engaging respective grooves 171*c* in an anchor bar 17*a* when the latching assistor member 30 is disposed between the bar and the associated latching plate 15*a*. Tab 322 thereon would then be extending upwards from end portion 12*a* towards the anchor bar, with grapnel elements 321 being engaged with the upper end of the plate. Plate 31 is retained within the groove 171 of an anchor bar by means of a pair of triangular catches 37*a*,37*b* protruding laterally from the lower portions of respective slats 31*a*,31*b* near the base thereof. The catches are adapted for readily allowing the insertion of plate 31 into a groove 171 while acting to lodge the member therein once in place. A latching assistor member 30 is also provided for the other end portion 12*b* on the housing with both members functioning and operating in a similar fashion as with those of the previous embodiment, including the provision of a spaced relationship between the grapnel elements thereon and associated latching plates.

Figure 7A:
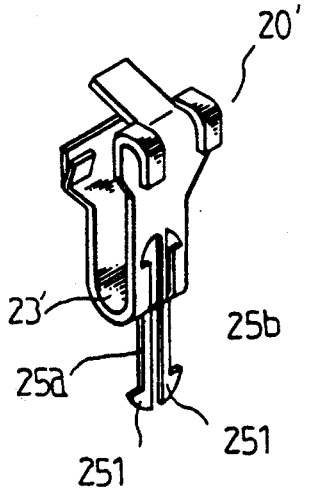
Figure 7B:
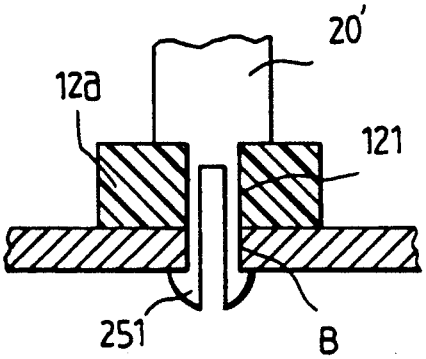
Figure 7C:
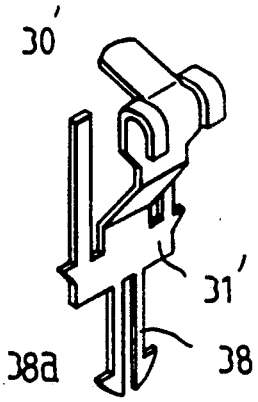

Yet another possible variation of the present invention relates to a means for mounting the electrical connector over a mother board wherein each assistor member is provided with resilient appendages that are lockably engageable with the cooperating board. As shown in FIG. 7*a*, the first latching assistor member has been modified into the form of 20' wherein a pair of incised, resilient snap-engagement fingers 25*a*,25*b* having a spaced relationship depend from the lower portion of bight 23' thereon. The barbed terminal ends 251 of the snap engagement fingers engage the lateral edges of a cooperating slot 121, as shown in FIG. 7*b*, formed on each end portion 12*a*,12*b* so as to effect their constriction when inserted through the slot. The snap-engagement fingers 25*a*,25*b* recover after the barbed ends thereon penetrate into a further, aligned slot B formed on an underlying printed circuit board and act to retain the housing thereover. FIG. 7*c* shows the second latching assistor member 30' being similarly provided with a pair of snap-engagement fingers 38*a*,38*b* depending from the base of the slide plate 31' thereof. As with latching assistor member 20', member 30' can fixedly position a housing having cooperating slots on respective end portions thereof over the aligned slots of an underlying circuit board.

Many further variations and modifications to the present invention could also be accomplished by a person of average skill in the art without departing from the scope thereof, and as such the specificities relating to the above embodiments should be construed to be exemplary rather than as limitative with the actual spirit and scope of the present invention being determined from the appended claims and their legal equivalents.

I claim:

1. An electrical connector for a printed circuit board comprising:

an insulative housing having opposing end portions and an insertion face having a trough-like recess extending therealong between said end portions for receiving said printed circuit board;

an integral, resilient latching plate on each said end portion extending away therefrom, each said plate having an abutment protruding from a first side thereof for engagement with a corresponding first side portion of said printed circuit board adjacent an edge thereof;

an integral positioning post on each said end portion extending away therefrom disposed at a predetermined position opposite from the first side of an associated said plate, each said post having a pin protruding therefrom that is substantially parallel directed with respect to the first side of associated said plate for engaging a corresponding cooperating aperture in said printed circuit board, with said post being adjacent a second side of said printed circuit board;

an integral anchor bar on each said end portion extending away therefrom disposed opposite a second side of an associated said plate, each said bar having an axial groove formed thereon of reentrant section facing the second side of an associated said plate;

a generally U-shaped resilient, latching assistor member having two legs adjoined by a bight, disposed over each said end portion between said bar and said plate thereof with the bight of each said latching assistor member being in proximity with the base of said plate, a first leg of each said latching assistor member being slidingly engaged within the groove of an associated said bar in a tongue and groove-like fashion;

retaining means for securing the first leg of each said latching assistor member in an associated said bar;

at least one generally hook-shaped grapnel element on the terminal end of the second leg of each said latching assistor member engaged with a terminal end portion of an associated said plate opposite from the base thereof; and an inclinate tab on a terminal end portion of the second leg of each said latching assistor member directed away from an associated said end portion and towards said bar thereof;

whereby, said printed circuit board can be secured in a functional position in said recess by applying force to said tab, in each said end portion, so as to effect the flexure of said latching assistor member wherein the second leg is flexed toward the first leg and said plate carried thereby is flexed towards said bar, inserting a connecting edge portion of said printed circuit board into said recess at an acute angle with respect to said insertion face wherein said printed circuit board is spaced from each said post, rotating said printed circuit board so as to engage each cooperating aperture thereon with a corresponding said pin, and allowing said latching assistor member and said plate to recover so as to engage said abutment thereon with the corresponding first side portion of said printed circuit board.

2. An electrical connector for a printed circuit board according to claim 1, wherein the overhanging portion of each said grapnel element is separated from the first side of a corresponding said plate engaged therewith by a predetermined space.

3. An electrical connector for a printed circuit board according to claim 2, wherein the second leg of each said latching assistor member has a broadened terminal end portion including two said grapnel elements adjacent respective lateral edges thereof, with said tab being disposed between the two said grapnel elements.

4. An electrical connector for a printed circuit board according to claim 3, wherein:

the first leg of each said latching assistor member has a broadened terminal end portion, the laterally protruding portions thereof defining respective tongues; and in each said bar, said groove includes a rear section in communication with the opening of said groove and being broadened with respect thereto, the rear section defining a pair of opposing lateral grooves for engagement with the respective tongues of the first leg of an associated said latching assistor member.

5. An electrical connector for a printed circuit board according to claim 4, wherein said retaining means comprises two inclinate outer flaps on the respective tongues of each said latching assistor member, the two outer flaps of each latching assitor member being flexed towards a common plane when the first leg thereof is inserted into an associated said bar.

6. An electrical connector for a printed circuit board according to claim 4, further comprising two snap engagement fingers depending from the bight of each said latching assistor member and a cooperating slot on each said end portion and on an underlying printed circuit board, each engagement finger of a said latching assistor member having a barbed terminal end, said engagement fingers of each said latching assistor member being engageable through aligned slots on an associated said end portion and underlying printed circuit board.

7. An electrical connector for a printed circuit board comprising:

an insulative housing having opposing end portions and an insertion face having a trough-like recess extending therealong between said end portions for receiving said printed circuit board;

an integral, resilient latching plate on each said end portion extending away therefrom, each said plate having an abutment protruding from a first side thereof for engagement with a corresponding first side portion of said printed circuit board adjacent an edge thereof;

an integral positioning post on each said end portion extending away therefrom disposed at a predetermined position opposite from the first side of an associated said plate, each said post having a pin protruding therefrom that is substantially parallel directed with respect to the first side of associated said plate for engaging a corresponding cooperating aperture in said printed circuit board, with said post being adjacent a second side of said printed circuit board;

an integral anchor bar on each said end portion extending away therefrom disposed opposite a second side of an associated said plate, each said bar having an axial groove formed thereon of reentrant section facing the second side of associated said plate;

a resilient, latching assistor member having a slide plate and an arm extending therefrom, disposed over each said end portion between said bar and said plate thereof, the slide plate of each said latching assistor member being slidingly engaged within the groove of an associated said bar in a tongue and groove-like fashion with the arm thereof extending away from an associated said end portion and towards said plate thereof, each said arm having a backing portion adjacent an associated said plate;

retaining means for securing the slide plate of each said latching assistor member in an associated said bar;

at least one generally hook-shaped grapnel element on the terminal end of the backing portion on each latching assistor member engaged with a terminal end portion of an associated said plate opposite from the base thereof; and an inclinate tab on a terminal end portion of the backing portion on each latching assistor member directed away from an associated said end portion and towards said bar thereof;

whereby, said printed circuit board can be secured in a functional position in said recess by applying force to said tab, in each said end portion, so as to effect the flexure of said latching assistor member wherein the second leg is flexed toward the first leg and said plate carried thereby is flexed towards said bar, inserting a connecting edge portion of said printed circuit board into said recess at an acute angle with respect to said insertion face wherein said printed circuit board is spaced from each said post, rotating said printed circuit board so as to engage each cooperating aperture thereon with a corresponding said pin, and allowing said latching assistor member and said plate to recover so as to engage said abutment thereon with the corresponding first side portion of said printed circuit board.

8. An electrical connector for a printed circuit board according to claim 7, wherein the overhanging portion of each said grapnel element is separated from the first side of a corresponding said plate engaged therewith by a predetermined space.

9. An electrical connector for a printed circuit board according to claim 8, wherein the backing portion on each said latching assistor member has a broadened terminal end portion including two said grapnel elements adjacent respective lateral edges thereof, with said tab being disposed between the two said grapnel elements.

10. An electrical connector for a printed circuit board according to claim 9, wherein:

the slide plate of each said latching assistor member has two lateral side portions defining respective tongues; and in each said bar, said groove includes a rear section in communication with the opening of said groove and being broadened with respect thereto, the rear section defining a pair of opposing lateral grooves for engagement with the respective tongues of the first leg of an associated said latching assistor member.

11. An electrical connector for a printed circuit board according to claim 10, wherein said retaining means comprises two triangular catches protruding from respective lateral side portions of the slide plate of each said latching assistor member proximate the base thereof, the catches engage respective lateral grooves in an associated said bar to lodge said latching assistor member therein.

12. An electrical connector for a printed circuit board according to claim 10, further comprising two snap engagement fingers depending from the base of the slide plate of each said latching assistor member and a cooperating slot on each said end portion and on an underlying printed circuit board, each engagement finger of said latching assistor member having a barbed terminal end, said engagement fingers of each said latching assistor member being engageable through aligned slots on an associated said end portion and underlying printed circuit board.

* * * * *